US006939196B2

(12) United States Patent
Bellon

(10) Patent No.: US 6,939,196 B2
(45) Date of Patent: Sep. 6, 2005

(54) OMNIDIRECTIONAL TOY MANIPULATOR

(76) Inventor: Michael Lee Bellon, 4513 Cove Dr., Carlsbad, CA (US) 92008

( * ) Notice: Subject to any disclaimer, the term of this patent is extended or adjusted under 35 U.S.C. 154(b) by 0 days.

(21) Appl. No.: 10/746,053

(22) Filed: Dec. 23, 2003

(65) Prior Publication Data

US 2005/0136791 A1 Jun. 23, 2005

(51) Int. Cl.[7] ..... A63J 19/00; A63H 17/16

(52) U.S. Cl. ..... 446/366; 446/239; 446/266; 446/330; 446/376; 446/440; 446/361

(58) Field of Search ..... 446/240, 239, 446/246, 266, 268, 330, 352, 359, 333–336, 446/376, 440, 361–367, 490

(56) References Cited

U.S. PATENT DOCUMENTS

| | | | | |
|---|---|---|---|---|
| 2,705,850 A | * | 4/1955 | Evans | 446/363 |
| 2,860,446 A | * | 11/1958 | Williams | 446/363 |
| 3,574,969 A | | 4/1971 | Cleveland et al. | |
| 4,457,097 A | * | 7/1984 | Miller et al. | 446/327 |
| 4,938,698 A | | 7/1990 | Chantry | |
| 5,094,646 A | | 3/1992 | Marceau | |
| 5,980,357 A | * | 11/1999 | Newby | 446/366 |
| 6,146,237 A | | 11/2000 | Rehkemper et al. | |
| 6,371,828 B1 | | 4/2002 | Ngan | |
| 6,431,940 B1 | | 8/2002 | Buford et al. | |

FOREIGN PATENT DOCUMENTS

| | | | | |
|---|---|---|---|---|
| CH | 680906 A5 | * | 12/1992 | A63H 3/18 |
| GB | 2130495 A | * | 6/1984 | A63H 17/00 |

* cited by examiner

*Primary Examiner*—Jessica Harrison
*Assistant Examiner*—Bena Miller
(74) *Attorney, Agent, or Firm*—Donn K. Harms

(57) ABSTRACT

A hand held omnidirectional toy figure manipulator allowing an operator to manipulate a puppet like toy figure concurrently with a variety of miniature toy replica devices such as a skateboard, a surfboard, a bicycle or a motorcycle in a wide variety of associated and disassociated trick style movements. The device works with a one or a plurality of actuators and communicating control rods operating in attachment to the toy replica and using a tubular member attached to the torso of a toy figure.

19 Claims, 5 Drawing Sheets

OMNIDIRECTIONAL TOY MANIPULATOR

FIELD OF THE INVENTION

The disclosed device herein relates to toys. More particularly the device relates to an omnidirectional toy figure manipulator which may be employed to remotely manipulate toy figures similar to a hand puppets or string puppets. The device herein disclosed provides a new and unique method of remotely manipulating not only the figures but other toys in conjunction with devices such as skateboards, surfboards, bicycles and motorcycles, all in an omnidirectional fashion.

BACKGROUND OF THE INVENTION

Puppets have held the interest of children and adults for many years. The most common types of puppets are the single hand-operated puppets and the string-operated puppets. With the single hand-operated puppet you put your hand into the body section and operate the arms and head with your fingers. The string puppets are operated from above where the strings connect to the body, arms and legs. There have been no real innovative designs where both figures and devices like skateboards, surfboards, bicycles or motorcycles are operated at the same time. This omnidirectional toy figure manipulator offers the answer to the challenge of creating a puppet style of toy that has a wide variety of natural trick style movements to both the toy figure as well as devices like a skateboard, surfboard, bicycle or motorcycle.

REFERENCES SITED

U.S. Pat. No. 3,574,969 (Cleveland et al.) describes a miniature scooter for use with a walking doll allowing the doll to push and ride the scooter. The scooter includes a low flexible platform for receiving one foot of the doll, a hook for loosely capturing the foot on the scooter, and a handlebar that lies immediately in front of the doll's abdomen to prevent forward tipping. Cleveland describes a doll with a miniature scooter attached; it does not offer the capabilities of the omnidirectional toy figure manipulator or the advantages of moving the figure or the toy device separately in a variety of trick movements.

U.S. Pat. No. 4,457,097 (Miller et al.) teaches of a puppet toy and game which includes a configured body support having pivotally connected thereto an operable limb assembly in which an upper arm is pivotally connected to the body support, a forearm is pivotally carried on the upper arm, and an activation means activates the upper arm and forearm to extend the limb assembly into a striking position. A return means returns the limb assembly to an at-rest position, with the activation means including a triggering means that is located relative to the body support so as to allow an operator to grasp and carry the body support in one hand wile controlling the activation means simultaneously with the same band. A head is resiliently carried upon the body support to allow the head to return to its original position after being struck, and in toys in which a plurality of limb assemblies are provided the triggering means or levers are located to allow an operator to control the limb assemblies either independently or simultaneously with the same finger or thumb. Preferably at least the forearms are manufactured from a malleable plastic material. While Miller offers a unique style of boxing puppet to be controlled from inside of the body of the figure by the hand of the operator, it does not offer the unique capabilities of the omnidirectional toy figure manipulator with the wide variety of associated and disassociated trick style movements.

U.S. Pat. No. 4,938,698 (Chantry) discloses a device for use in aiding a snowboard trainee in practicing a variety of snowboard maneuvers having an elongated platform conformal to and simulating a miniature snowboard, including a slightly up-curved tail and a more pronounced upwardly curved nose. The platform nose and tail are integrally joined by a flat mid-portion carrying a pair of attachment pads on its upper surface adapted to be detachably connected with a pair of finger couplers carried on the fingertips of the user. Attachment devices releasably connect the finger couplers with the attachment pads. Chantry may disclose a finger operated toy device, but does not offer the many capabilities offered by the omnidirectional toy figure manipulator.

U.S. Pat. No. 5,094,646 (Marceau) additionally describes a controller for a remote toy vehicle includes a housing that is formed in the configuration of a control toy vehicle and a control assembly for controlling the operation of the remote toy vehicle. The control assembly includes a manually manipulateable direction control member which is directionally related to the control toy vehicle and manipulateable relative thereto for effecting corresponding movements in the remote toy vehicle. Marceau, however, describes the operation of an electronic remote controlled toy and does not enter the field of puppet style of toys.

U.S. Pat. No. 6,146,237 (Rehkemper et al.) teaches a toy bicycle that is a scale model including frame, seat, handlebar, front and rear wheel and drive assemblies comparable to a full-sized bicycle. There is also included front and rear braking mechanisms that can be readily and easily finger operated. The bicycle includes pedal and foot pegs that are oversized relative to the other components to facilitate finger operation of the bicycle. The handlebar is provided with projections to enable one playing with it to perform stunts. Rehkemper is another patent that discloses a finger operated toy but does not have the capabilities of functioning with a toy figure and a toy device in a variety of different trick movements.

U.S. Pat. No. 6,371,828 B1 (Ngan) tells of a hand-driven toy for playing by the hand of a player, which toy comprises a body, front and back wheels, and a steering member for steering the front wheel. The toy includes a pair of finger connectors attachable to the steering member for enabling the index and middle fingers of the band to maneuver the steering member. Each connector resembles a gauntlet having a fist for gripping a respective opposite part of the steering member and a cuff for frictional engagement by a respective finger such that the toy may be held and driven by the hand to move on a surface. This is yet another teaching which discloses a finger operated toy but does not have the capabilities of functioning with a toy figure and a toy device in a variety of different trick movements.

U.S. Pat. No. 6,431,940 B1 (Buford) describes a toy doll that is articulated and removably attached to a toy scooter so that the doll's arms appear to steer the scooter and the doll's foot appears to tilt downward to push back against the ground and propel the scooter. The animated toy doll and scooter assembly is controlled by a remote control radio, itself shaped like a scooter and having a toy foot attached to it. The toy foot slides forward or back to control the forward and reverse motion of the scooter and is turned side to side to steer the scooter. Buford only describes another doll with a miniature scooter attached and it does not offer the capabilities of the omnidirectional toy figure manipulator or the advantages of moving the figure or the toy device separately in a variety of trick movements.

Thus there is a continuing need for new and unique toys to entertain both children and adults which allow for the easy hand manipulation of the toy and engagement of the toy manipulated with a second toy for manipulation of the engaged pair.

In this respect, before explaining at least one embodiment of the invention in detail, it is to be understood that the invention is not limited in its application to the details of construction and to the arrangement, of the components set forth in the following description or illustrated in the drawings. The disclosed invention herein is capable of other embodiments and of being practiced and carried out in various ways. Also, it is to be understood that the phraseology and terminology employed herein are for the purpose of description and should not be regarded as limiting.

SUMMARY OF THE INVENTION

A first preferred embodiment of the omnidirectional toy figure manipulator device will indirectly manipulate a toy figure and an engaged miniature toy device like a skateboard, surfboard, bicycle or a motorcycle in a wide variety of associated and disassociated trick style movements. The device consists of a primary actuator handle held in the right hand to hold and support the omnidirectional toy figure manipulator. The primary actuator handle has the ability of tipping the toy device to one side or the other by rocking the primary actuator handle toward the direction desired to tip the toy device. This action takes place by the means of the pressure exerted on the left control rod and the right control rod. These control rods have an angular bend at the top and bottom giving the leverage for the tipping action and are seated within a common swivel joint located in the rotational disk in the primary actuator handle and in the toy device. Additionally, the primary actuator handle has the ability to rotate the toy device by rotating the rotational disk with the thumb through the rotational disk cutout that rotates on the pivot pin in the primary actuator handle. The rotation of the toy device takes place through the central control rod. The central control rod is rigidly affixed in the rotational disk and has a swivel joint in the center of the toy device.

A second actuator having serrated reliefs on each side to be operated by the thumb and forefinger of the right hand will additionally rotate the toy device and also facilitate the tipping front and back of the toy device by the means of the tipping front and back control rod moving up and down. The tipping front and back control rod is operatively affixed in the second actuator with an angular bend and affixed to the toy device by the means of a swivel joint. An orifice in the center of the second actuator allows clearance for the left control rod and the right control rod and the central control rod to pass through to connect to the toy device.

A third actuator consists of a serrated wheel operatively attached to a tube of varying lengths that is rigidly affixed through a passage in the torso of the toy figure being controlled. The third actuator creates the means for the rotational movement and vertical translation of the toy figure, completely unrelated to movements of the second toy device and is operated by the left hand. The tube also allows the clearance for the left control rod, the right control rod, the central control rod and the tipping front and back control rod to pass through the torso of the toy figure to connect to the second toy device. The tube and all the control rods will best be painted black to make the toy figure and the toy device appear disconnected.

On the sides of the tube of the third actuator will consist of one or more sliding actuators connected to different spring-loaded portions of the toy figure's body such as the legs, arms, torso, or any combined, by the means of cables or filament strands.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

OBJECTS OF THE INVENTION

The object of the invention is to remotely manipulate a toy figure and a toy device like a skateboard, surfboard, bicycle or a motorcycle in a wide variety of associated and disassociated movements.

Another object of this invention is to manipulate a toy figure and a toy device like a skateboard, surfboard, bicycle or a motorcycle and make them appear as lifelike as possible.

A further object of this invention is to remotely or indirectly manipulate the body parts of a toy figure of a rider and also a toy device like a skateboard, surfboard, bicycle or a motorcycle doing simulated difficult stunt tricks.

Still another object of the omnidirectional toy figure manipulator is to create a device that may be simplified to as few as two control rods for a simply operated toy and as many as four or more control rods with sliding actuators for a more complicated toy along with many options in between and still stay within the scope of this patent.

Yet another object of this invention is to indirectly manipulate a toy figure and a toy device like a skateboard, surfboard, bicycle or a motorcycle separately at the same time without the obvious connection to the operator.

A further object of the omnidirectional toy figure manipulator is to indirectly manipulate a toy figure and a toy device like a skateboard, surfboard, bicycle or a motorcycle in as many as varied and unique operations as possible.

An additional object of the omnidirectional toy figure manipulator is to create a means to entertain children and adults in a new and unique way.

These togbjects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

There has thus been outlined rather broadly the more important features of the invention in order that the detailed description thereof that follows may be better understood and in order that the present contribution to the art may be better appreciated. There are additional features of the invention that will be described hereinafter and which will form the subject matter of the claims appended hereto.

BRIEF DESCRIPTION OF THE DRAWINGS

The accompanying drawings, which are incorporated in and form a part of this specification, illustrate embodiments of the invention and together with the description, serve to explain the principles of this invention.

DETAILED DESCRIPTION OF THE PREFERRED EMBODIMENTS

Figures 1, 2:
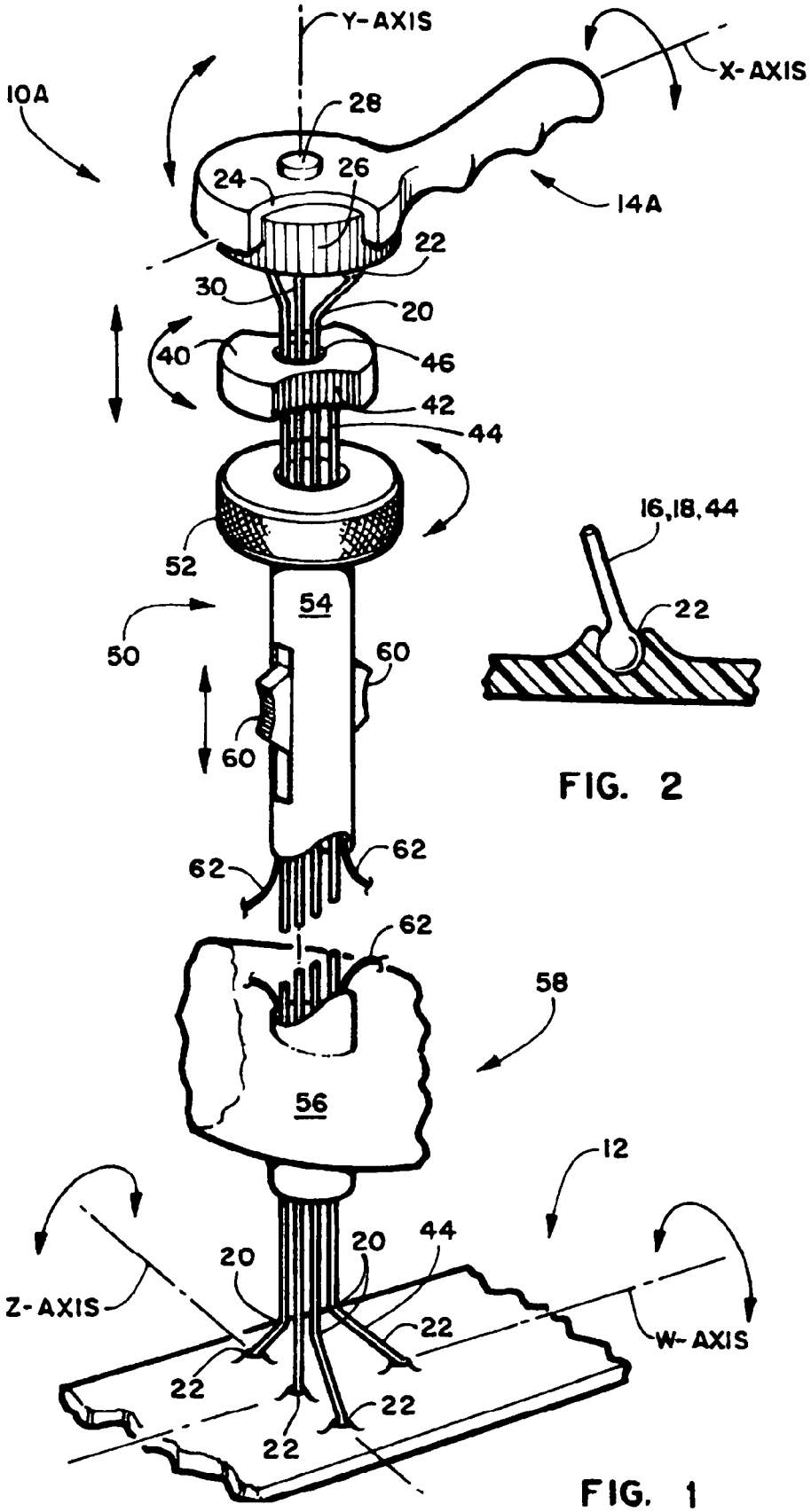
FIG. 1 depicts a perspective view of the omnidirectional toy figure manipulator
FIG. 2 depicts a section through the retention area of ball end of one of the control rods

Referring now to the drawings, wherein similar parts of the invention are identified by like reference numerals, there is seen the omnidirectional toy figure manipulator 10A that is adapted to manipulate a toy figure 58 such as the depicted puppet and a toy device 12 like a skateboard, surfboard, bicycle or a motorcycle in a wide variety of associated and disassociated movements.

The omnidirectional toy figure manipulator 10A consists of a primary actuator handle 14 which is best held in the right hand to hold and support the operatively engaged omnidirectional toy figure manipulator 10A. The primary actuator handle 14A provides a means for tipping the toy device 12 to one side or the other on the first or W-axis by rocking or rotating the primary actuator handle 14A in the X-axis, toward the direction desired to lower or tip the operatively engaged toy device 12. Rotating the actuator handle 14A causes a similar rotation of the toy device 12. This action occurs by the means of the pressure exerted on the left control rod 16 and the right control rod 18. These control rods 16 and 18 in the current preferred mode have an angular bend 20 at the top and bottom providing leverage for the tipping action and are seated within a swivel joint 22, illustrated in FIG. 2, located in the rotational disk 26 and in the toy device 12. Of course other means of rotational engagement might be used. It must be noted at this time the degree of the angle bend 20 and the length of the control rods 16 and 18 after the angle bend 20 will directly affect the amount of movement in the toy device 12 and any modifications and variations of these will be covered within the scope of this patent.

Additionally, the primary actuator handle 14A has the ability of rotating the toy device 12 about the Y-axis by rotating a rotational disk 26 with the thumb through the rotational disk cutout 24. The rotational disk 26 rotates about the Y-axis on the pivot pin 28. The rotation of the toy device 12 takes place through the central control rod 30 located on the Y-axis. The central control rod 30 is rigidly affixed in the rotational disk 26 and has a swivel joint 22 on the Z-axis, in the center of the toy device 12.

A second actuator 40 having serrated reliefs 42 on each side can be operated by the thumb and forefinger of the right hand will additionally rotate the toy device 12 and also facilitate tipping the front and back of the toy device 12 about the Z-axis, by the means of the front and back control rod 44 moving up and down. Moving the toy device 12 will inherently move the arms, legs, and torso, of the rider when they are operatively engaged with the toy device 12. This provides a means to rotate the toy device 12 on the Z-axis. The tipping front and back control rod 44 is rigidly affixed in the second actuator 40 with an angular bend 20 and affixed to the toy device 12 by the means of a swivel joint 22. An orifice 46 in the center of the second actuator 40 allows clearance for the left control rod 16 and the right control rod 18 and the central control rod 30 to pass through to connect to the toy device 12.

A third actuator 50 which is operable by the other or the left hand, consists of a serrated wheel 52 attached to a tube 54 which would vary in length depending on the toy figure 58 with which it is engaged thereover, the torso 56. The third actuator 50 provides a means for the rotational movement and the up and down or vertical translation of the toy figure 58 about the Y-axis in a manner that is completely unrelated to movements of the toy device 12. Thus an attached toy figure 58 may be manipulated independently of the toy device 12. The tube 54 also provides a passage to surround the left control rod 16, the right control rod 18, the central control rod 30 and the tipping front and back control rod 44 to pass through the torso of the toy figure 58 and to connect to the toy device 12. The tube 54 and all the control rods will best be painted black and will also be operated with the left hand of the operator and allow those connected portions of the body such as the arms and legs to be moved.

Figure 3:
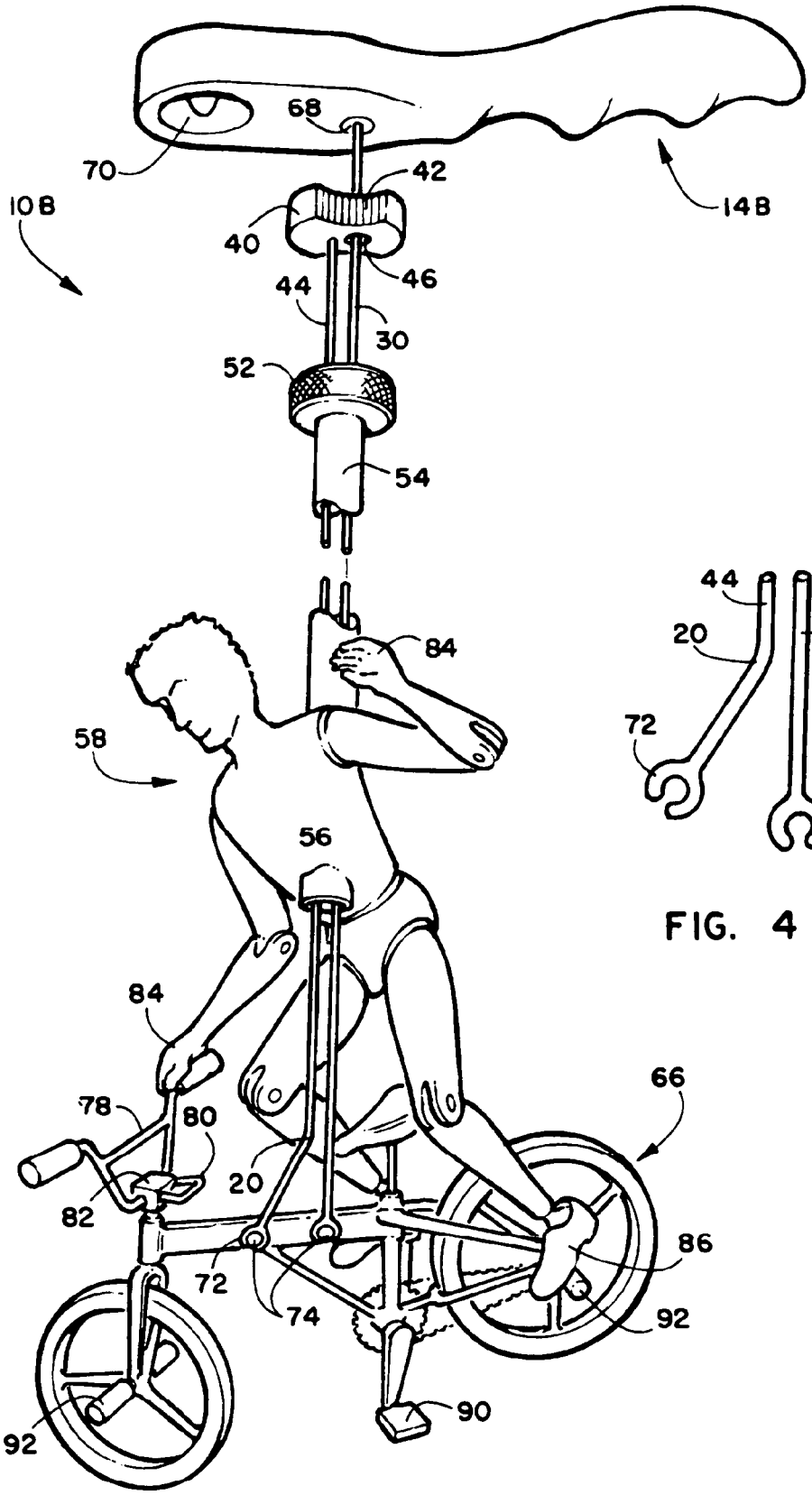
FIG. 3 depicts a perspective view of an alternate embodiment of the omnidirectional toy figure manipulator with the toy figure of the rider engaged on a bicycle.

FIG. 3 depicts a perspective view of an alternate embodiment of the omnidirectional toy figure manipulator 10B with the toy figure 58 shown engaged on a toy bicycle 66. The primary actuator handle 14B that has the central control rod 30 rotatably affixed to the primary actuator handle 14B through a bushing 68. Optionally, with this or the other preferred embodiments, a flashlight 70 to illuminate the toy figure 58 below may be incorporated into the design.

Figure 4:
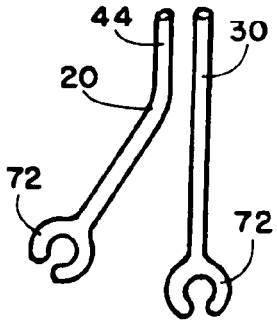
FIG. 4 depicts a side view of an alternate embodiment of the control rod attachment means.

A second actuator 40 having serrated relief's 42 on each side to be operated by the thumb and forefinger of the right hand provides a means to rotate the bicycle 66 around the axis formed by control rod 30 and also provides a means for tipping the front and back of the bicycle 66 by movement of the front and back control rod 44 moving up and down. Thus the attached miniature bicycle may be easily rotated or tipped back and forth by rotating or tipping the second actuator 40. The tipping front and back control rod 44 is rigidly affixed in the second actuator 40 with an angular bend 20 at its distal end and affixed to the bicycle by the means of C-clip's 72 that are incorporated into the ends of the tipping front and back control rod 44 and the central control rod 30 illustrated in FIG. 4.

The C-clip 72 ends will releasably attach to buttons 74 on the frame 76 of the bicycle 66 and the handlebar crossbar 78 and the attachment bar 80 on the gooseneck 82 of the bicycle 66. Of course other means of attachment providing a rotational engagement could be used and are anticipated.

Figure 6:
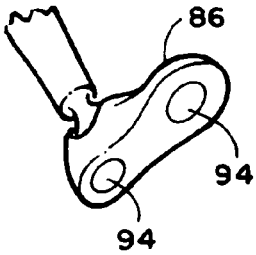
FIG. 6 depicts a perspective view of the bottom of a shoe of the toy figure rider with a pair of magnets inserted.

In a current preferred mode of the device where the toy figure 58 engages with another toy to mimic riding of this other toy, the hands 84 and feet 86 of the toy figure 58 are adapted for engagement with another toy such as the shown toy bicycle 66 or skateboard 12 through the provision of magnets 94. These magnets are internally mounted or attached to the surface in the appropriate positions on both the toy figure 58 and the engageable miniature toy such as the skateboard 12 or bicycle 66. The placement of magnets 94 is best illustrated in FIG. 6 which depicts a mounting in the feet 86 and similar mountings would be provided on all the toys and the toy figure 58 at the appropriate hand or foot engagement to provide a magnetic means of attachment of the toy figure 58 to the engaged toy. When used for engagement between a toy figure 58 and a toy such as a bicycle 66, magnets 94 would be situated on the handgrips 88 and/or the foot pedals 90 and/or the foot pegs 92 which would operatively attract and engage magnets 94 in the toy figure 58 and provide a means to engage the two. Using such a magnetic means for engagement also causes an immediate attraction between the toy figure 58 and the toy device 12 such as a miniature skateboard 12 when the toy figure 58 is placed in close proximity.

Figure 5:
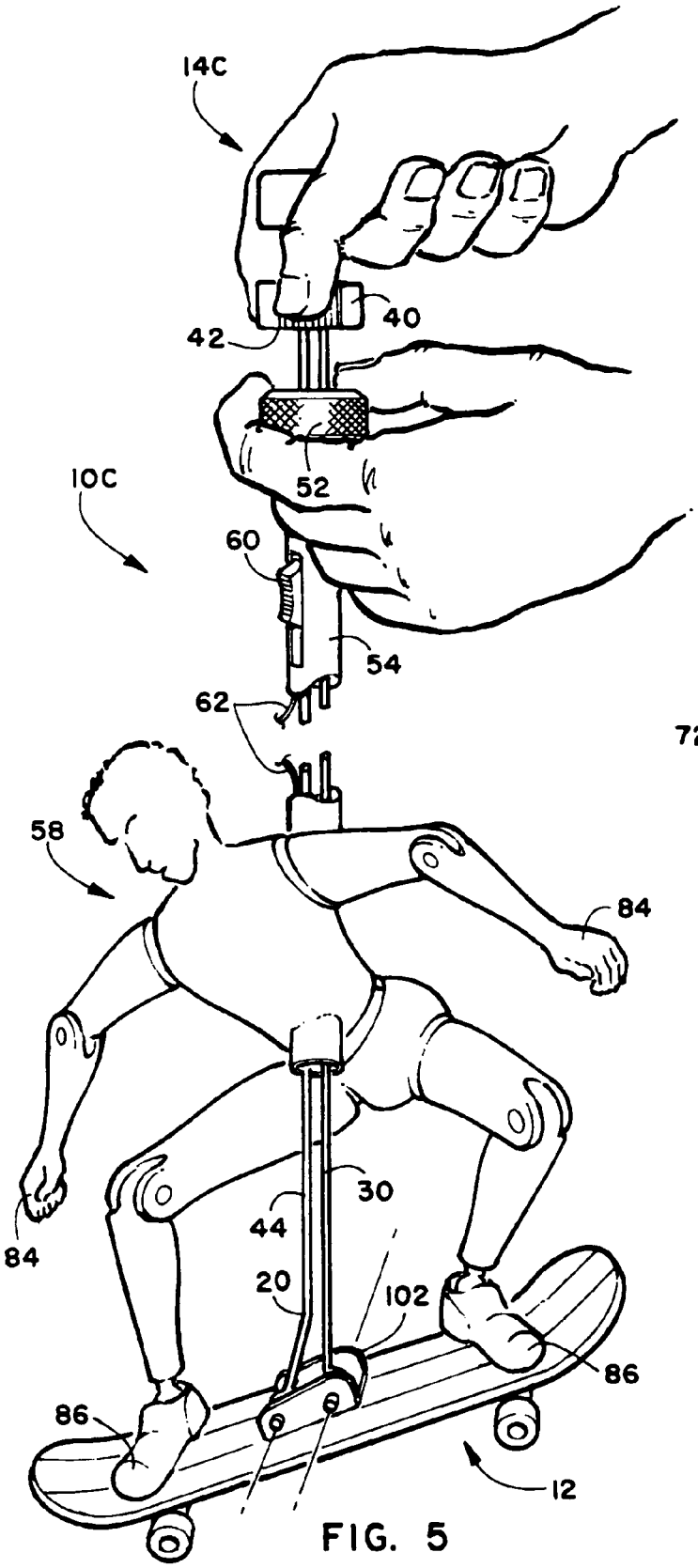
FIG. 5 depicts a perspective view of a second alternate embodiment of the omnidirectional toy figure manipulator with the toy figure rider engaged on a skateboard.
Figure 8:
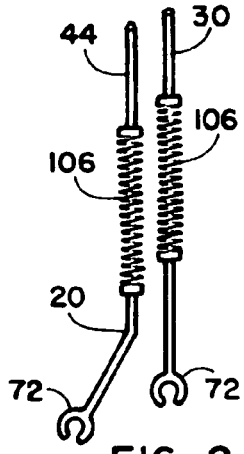
FIG. 8 depicts a side view of optional control rods with compression springs.
Figure 7:
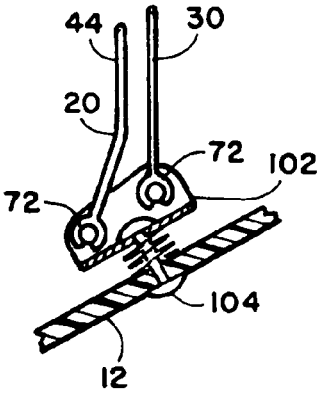
FIG. 7 depicts a section through the skateboard and an optional mounting bracket.

FIG. 5 depicts a perspective view of a another preferred embodiment of the omnidirectional toy figure manipulator 10C with the toy figure 58 engaged on a skateboard 100. This embodiment of omnidirectional toy figure manipulator 10C has the addition of the sliding actuator 60 and the cables or filament strands 62 to facilitate movement in the body of the toy rider and the limbs of the toy figure 58 rider. This embodiment is somewhat simpler than that of FIG. 1 in that it has fewer rods 30 and 44. The rods 30 and 44 could be engaged with swivel joints 22 as with the other embodiments or as shown in FIG. 5. This embodiment also has an optional bracket 102 style of attachment to the skateboard with the additional option of having the bracket 102 as the attachment point. The bracket 102 is spring loaded on a keyed shaft 104 to facilitate rotation by the second actuator 40 shown in FIG. 7. FIG. 8 depicts optional compression springs 106 incorporated in the design of the tipping front and back control rod 44 and the central control rod 30 which can be employed with this embodiment or the others if desired. While this embodiment would not allow for rotation on the W-axis as in that of FIG. 1, it is somewhat simpler to control for a less accomplished user.

Figure 9:
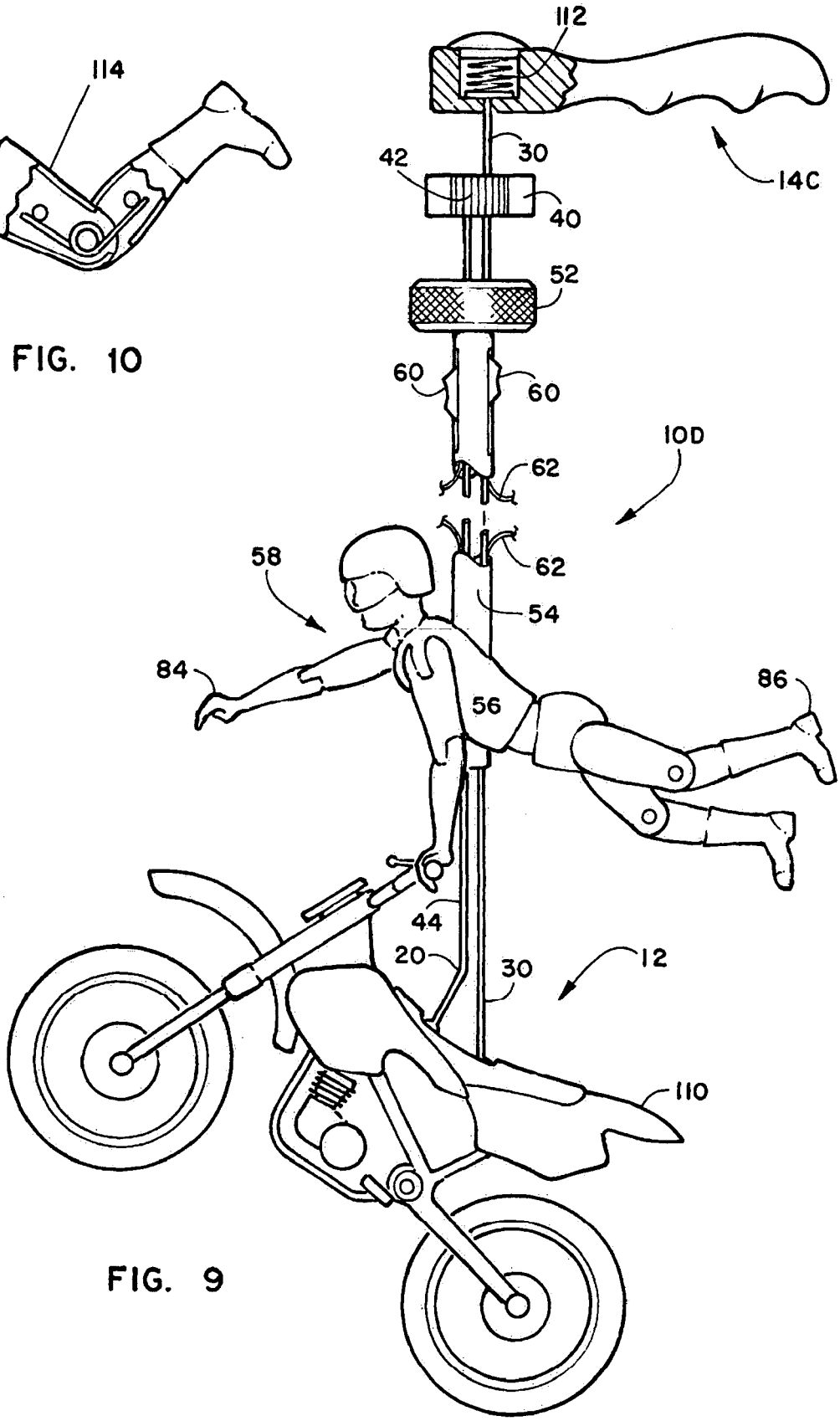
FIG. 9 depicts a side view of a third alternate embodiment of the omnidirectional toy figure manipulator with the toy figure rider engaged on a toy motorcycle.
Figure 11:
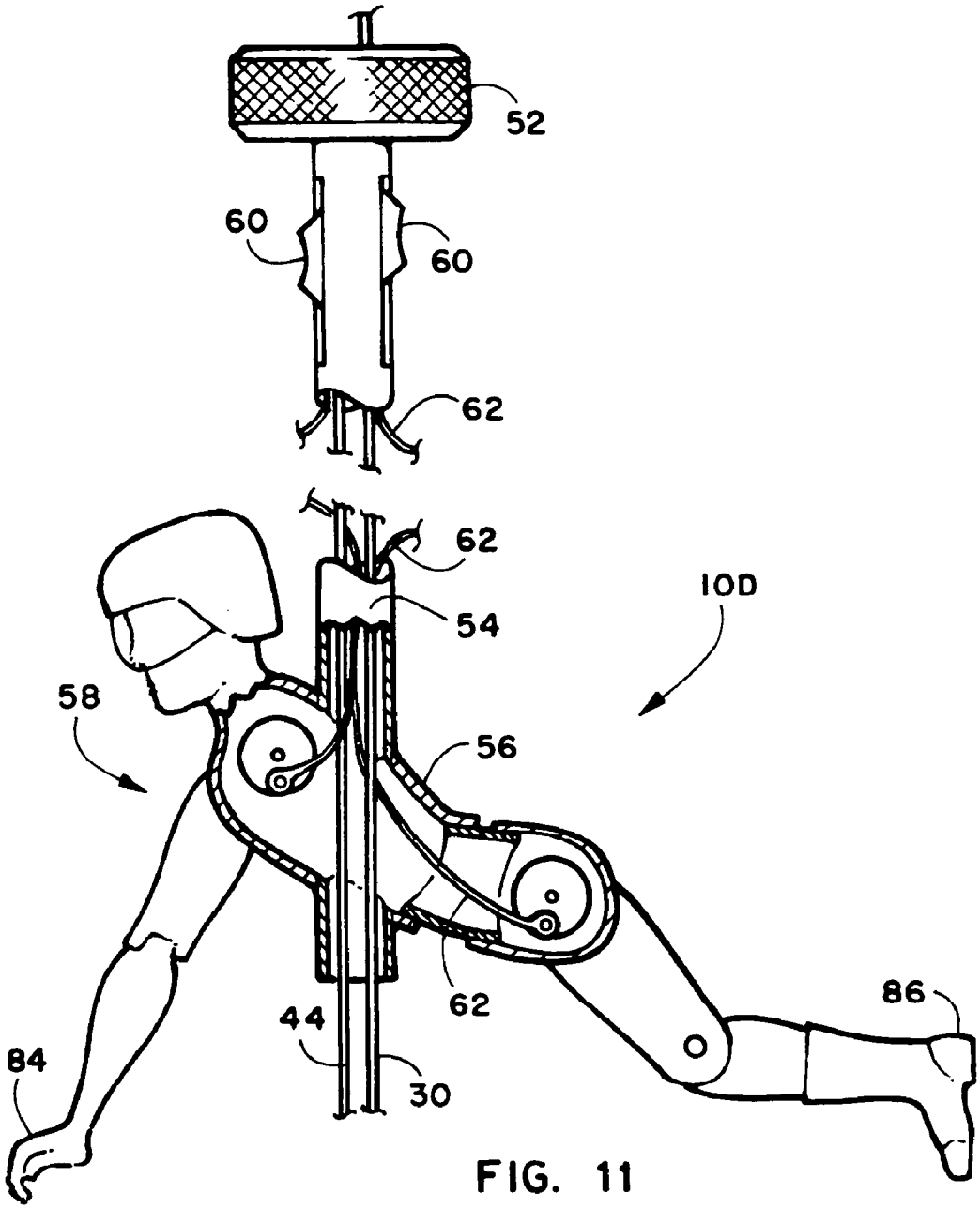
FIG. 11 depicts another preferred embodiment of the disclosed device showing tethers engaged to the limbs of the rider.

FIG. 9 depicts a side view of an other preferred embodiment of the omnidirectional toy figure manipulator 10D with the toy figure 58 engaged with a toy motorcycle 110. This embodiment of the omnidirectional toy figure manipulator 10D has the addition of two sliding actuators 60 and the cable or filament strands 62 as a means for activating and controlling additional movement in the body of the toy FIG. 58. Additionally, a cushion spring 112 has been added to the primary actuator handle 14C. This cushion spring 112 might also be used with the other embodiments. The same magnets 94 would be used as a means to engage the motorcycle and the toy figure 58 or with regard to the hands 84 of the toy figure 58 they can be formed in a shape and size to removably and rotationally engage the handlebars of the motorcycle.

Figure 10:
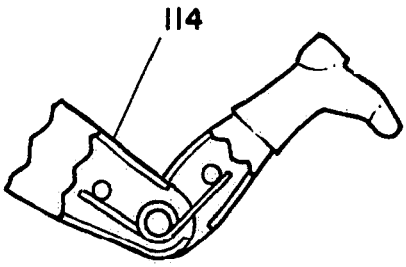
FIG. 10 is a sectional view of one of the spring-loaded legs of the toy figure rider.

FIG. 10 is a sectional view of one of the spring-loaded legs 114 of the toy figures 58, indicating that any of the joints, arms or legs of the toy figures 58 may be spring loaded to enhance the motion when the toy figures 58 is moved away and attachment is released by the magnets on any of the toy devices 12.

The depicted toy figure manipulators, while shown and described for use in combination with toy or miniature skateboards, bicycles and motorcycles, would also work to manipulate miniature components from a plurality of other sports including but not limited to: hockey, tennis, soccer, racquetball, basketball, volleyball, badminton, wakeboarding, snowboarding, skiing, rollerblading, surfing, baseball, football, boxing, fencing, skating, skateboarding, wrestling, quad cycles, bicycling, jet skis, wave runners, lacrosse, gymnastics, fishing, horseshoes, horseback riding and jumping, pool, darts, archer, shooting, ping-pong, cheer leading, musician, military guy, golf, NASCAR, off road racing, and go-carting.

The omnidirectional toy figure manipulator 10 shown in the drawings and described in detail herein disclose arrangements of elements of particular construction and configuration for illustrating preferred embodiments of structure and method of operation of the present invention. It is to be understood, however, that elements of different construction and configuration and other arrangements thereof, other than those illustrated and described, may be employed for providing a omnidirectional toy figure manipulator 10 in accordance with the spirit of this invention, and such changes, alternations and modifications as would occur to those skilled in the art are considered to be within the scope of this invention as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

What is claimed is:

1. A toy manipulator comprising:

an elongated actuator handle having a handle center axis running therethrough;

a central control rod attached at a first end to said actuator handle;

said central control rod having a distal end having an engagement point adapted for rotational engagement with a toy;

said central control rod defining a vertical axis, said vertical axis substantially normal to said handle center axis;

a second actuator;

at least one tipping rod attached to said second actuator at a first end and having an attachment end opposite said first end;

said attachment end adapted for rotational engagement with said toy;

a toy rider;

said toy rider having limbs said limbs having arms terminating at hands and leas terminating at feet;

said toy rider also having a torso;

a passage extending through said torso dimensioned to accommodate translation of said control rod and said tipping rod therethrough;

means for removable attachment of at least one of said feet of said toy rider to said toy; and whereby said toy engaged with said central control rod and said tipping rod is tiltable around said engagement point by lateral translation of said second actuator and rotatable around said vertical axis by rotation of said actuator handle.

2. The toy manipulator of claim 1, wherein said means for removable attachment of at least one of said feet of said toy rider to said toy is a means for magnetic attraction between said one of said feet and said toy.

3. The toy manipulator of claim 2, additionally comprising:

a third actuator;

a control member attached at a first end to said third actuator and at a second to said torso of said toy rider; and said torso of said toy rider translatable toward and away from said toy when at least one said feet of said toy rider are engaged with said toy, by translation of said third actuator.

4. The toy manipulator of claim 3, additionally comprising:

means for removable attachment of at least one of said hands of said toy rider to said toy.

5. The toy manipulator of claim 3, additionally comprising:

at least one sliding actuator engaged with said control member;

at least one cable attached to said sliding actuator at a first end; and said cable in communication at a distal end, opposite said first end, with at least one of said limbs of said toy rider, wherein sliding said toy acturator will result in movement of said one of said limbs of said toy rider.

6. The toy manipulator of claim 3, additionally comprising:

said third actuator rotatable around said vertical axis; and said rotational engagement of said distal end of said central control rod at said engagement point providing means for rotation of said toy around said central axis and said vertical axis.

7. The toy manipulator of claim 2, additionally comprising:

means for removable attachment of at least one of said hands of said toy rider to said toy.

8. The toy manipulator of claim 7, additionally comprising:

at least one sliding actuator engaged with said control member;

at least one cable attached to said sliding actuator at a first end; and said cable in communication at a distal end, opposite said first end, with at least one of said limbs of said toy rider, wherein sliding said toy actuator will result in movement of said one of said limbs of said toy rider.

9. The toy manipulator of claim 1, additionally comprising:

a third actuator;

a control member attached at a first end to said third actuator and at a second to said torso of said toy rider; and said torso of said toy rider translatable toward and away from said toy by translation of said third actuator.

10. The toy manipulator of claim 9, additionally comprising:

means for removable attachment of at least one of said hands of said toy rider to said toy.

11. The toy manipulator of claim 10, additionally comprising:

at least one sliding actuator engaged with said control member;

at least one cable attached to said sliding actuator at a first end; and said cable in communication at a distal end, opposite said first end, with at least one of said limbs of said toy rider, wherein sliding said toy actuator will result in movement of said one of said limbs of said toy rider.

12. The toy manipulator of claim 11, additionally comprising:

said third actuator rotatable around said vertical axis; and said rotational engagement of said distal end of said central control rod at said engagement point providing means for rotation of said toy around said central axis and said vertical axis.

13. The toy manipulator of claim 9, additionally comprising:

said third actuator rotatable around said vertical axis; and said rotational engagement of said distal end of said central control rod at said engagement point providing means for rotation of said toy around said central axis and said vertical axis.

14. The toy manipulator of claim 13, additionally comprising:

said third actuator rotatable around said vertical axis; and said rotational engagement of said distal end of said central control rod at said engagement point providing means for rotation of said toy around said central axis and said vertical axis.

15. The toy manipulator of claim 1, additionally comprising:

means for removable attachment of at least one of said hands of said toy rider to said toy.

16. The toy manipulator of claim 15, additionally comprising:

at least one sliding actuator engaged with said control member;

at least one cable attached to said sliding actuator at a first end; and said cable in communication at a distal end, opposite said first end, with at least one of said limbs of said toy rider, wherein sliding said toy acturator will result in movement of said one of said limbs of said toy rider.

17. The toy manipulator of claim 16, additionally comprising:

said third actuator rotatable around said vertical axis; and said rotational engagement of said distal end of said central control rod at said engagement point providing means for rotation of said toy around said central axis and said vertical axis.

18. A toy manipulator comprising:

an elongated actuator handle having a handle center axis running therethrough;

a central control rod attached at a first end to said actuator handle;

said central control rod having a distal end having an engagement point adapted for rotational engagement with a toy;

said central control rod defining a vertical axis, said vertical axis substantially normal to said handle center axis;

a second actuator;

at least one tipping rod attached to said second actuator at a first end and having an attachment end opposite said first end;

said attachment end adapted for rotational engagement with said toy;

a toy rider;

said toy rider having limbs said limbs having arms terminating at hands and legs terminating at feet;

said toy rider also having a torso;

a passage extending through said torso dimensioned to accommodate translation of said control rod and said tipping rod therethrough;

means for removable attachment of at least one of said hands of said toy rider to said toy; and whereby said toy engaged with said central control rod and said tipping rod is tiltable around said engagement point by lateral translation of said second actuator and rotatable around said vertical axis by rotation of said actuator handle.

19. The toy manipulator of claim 18, wherein said means for removable attachment of at least one of said hands of said toy rider to said toy is a means for magnetic attraction between said one of said hands and said toy.

* * * * *